United States Patent [19]

Lilie

[11] 4,303,509

[45] Dec. 1, 1981

[54] SEPARATING APPARATUS

[76] Inventor: Kenneth R. Lilie, 11403 Sageking, Houston, Tex. 77089

[21] Appl. No.: 182,122

[22] Filed: Aug. 28, 1980

[51] Int. Cl.[3] ..... B07B 1/46

[52] U.S. Cl. ..... 209/403

[58] Field of Search ..... 209/393–395, 209/397–405

[56] References Cited

U.S. PATENT DOCUMENTS

| | | | |
|---|---|---|---|
| 1,932,920 | 10/1933 | Berghoefer | 209/403 |
| 2,271,900 | 2/1942 | Mowbray | 209/403 |
| 3,483,912 | 12/1969 | Andrews | 209/403 X |
| 4,140,630 | 2/1979 | Scarlett et al. | 209/403 X |

*Primary Examiner*—William A. Cuchlinski, Jr.
*Attorney, Agent, or Firm*—Bill B. Berryhill

[57] ABSTRACT

Apparatus for separating solid materials from mixtures having solid materials therein, including a wire mesh screen the two opposing edges of which are retained by elongated rigid retainer assemblies against which oppositely directed forces may be applied for placing the screen in tension. Each of the rigid retainer assemblies may comprise: a first rigid retainer member having an elongated flat base portion from one edge of which upwardly projects a curved rib portion providing an elongated arcuate convex surface; a second rigid retainer member having an elongated base portion from one edge of which upwardly projects a curved rib portion providing an elongated arcuate concave surface; and a third rigid retainer member including a flat elongated base portion from one edge of which upwardly projects a rib portion for disposition between the elongated arcuate convex surface of the first retainer member and the elongated arcuate concave surface of the second retainer member.

6 Claims, 4 Drawing Figures

SEPARATING APPARATUS

BACKGROUND OF THE INVENTION

1. Field of the Invention

The present invention pertains to apparatus for separating solid materials from mixtures having such solid materials therein. In particular, it pertains to separating apparatus in which the two opposing edges of a wire mesh screen are retained by elongated retainer assemblies against which oppositely directed forces may be applied for placing the screen in tension. Specifically, the present invention pertains to rigid retainer assemblies for use with such separating apparatus.

2. Description of the Prior Art

There are many methods and apparatus for separating solid materials from mixtures having such solid materials therein. In some of these methods, a wire mesh screen is provided for separating the solid materials from dry or wet mixtures containing such solid materials. For example, such screens are frequently used in shale separation and in separating cuttings from drilling muds being circulated in oil and/or gas wells. The wire mesh screen is usually placed in tension and may even be vibrated to aid in the separation process.

Since the wire screen is preferably placed in tension, it is necessary that some means be provided for retaining or holding the edges thereof and placing the screen in tension. For this reason, various types of retainer assemblies have been developed for attachment to opposing edges of the screen. These retainer assemblies may then be engaged by some means for applying forces thereto to place the screen in tension. Since a considerable force may be applied thereto, one of the problems associated with such apparatus is tearing of the screen or separation of the edges thereof from the retainer assemblies.

In recent years, a two-piece retainer assembly has been developed, between the two pieces or members thereof which the edges of the screen are tightly clamped. One of these members may comprise an elongated flat base portion from one edge of which upwardly projects a curved rib portion providing an elongated arcuate convex surface. Another member may also include an elongated base portion from one edge of which upwardly projects a curved rib portion providing an elongated arcuate concave surface. The edge of the screen is sandwiched between the curved rib portions of the respective retainer members for gripping thereby. When forces are applied to the retainer assemblies, the edges of the screen are tightly gripped by the respective retainer members and the screen placed in tension.

Even though the two retainer members and the screen may be welded together by spot welding, it is not uncommon for the screen to tear and disengage the retainer assemblies, or to become so loose therein that tension cannot be retained on the screen. This, of course, reduces the separation efficiency thereof.

SUMMARY OF THE INVENTION

In the present invention, rigid retainer assemblies are also provided for retaining the edges of a wire mesh screen and by which oppositely directly forces may be applied for placing the screen in tension. However, the retainer assemblies of the present invention include three members. The first and second members are very similar to the two-piece retainer assemblies of the prior art. The first member may include an elongated flat base portion from one edge of which upwardly projects a curved rib portion providing an elongated arcuate convex surface. The second retainer member may include an elongated base portion from one edge of which upwardly projects a curved rib portion providing an elongated arcuate concave surface. However, a third retainer member is provided including a flat elongated base portion from one edge of which upwardly projects a rib portion for disposition between the elongated arcuate convex surface and the elongated arcuate concave surface of the first and second retainer members, respectively.

The edge of the wire screen lies alongside the elongated base portion of the third retainer member for sandwiching between the elongated base portions of the first and second retainer members and is wrapped around the rib portion of the third retainer member for sandwiching between the arcuate convex surface of the first retainer member and the arcuate concave surface of the second retainer member. Thus, a greater frictional engagement of the screen edge is provided with this arrangement. The fact that the screen edge is wrapped around the rib portion of the third retainer member results in greater integrity and strength of the connection between the screen and the retainer assembly. Other features of the retainer assembly of the present invention will be pointed out in the description.

The resulting separating apparatus is superior to those of the prior art in that the edges of the wire mesh screen are more firmly retained by the retainer assemblies so that greater forces may be applied for placing the screen in tension and so that the edges of the screen are less likely to be torn or pulled from between the components of the retainer assembly. The retainer assembly of the present invention is relatively easy to manufacture and assemble. Even though it might be slightly greater in cost than apparatus of the prior art, its superior characteristics make it much more desirable than apparatus of the prior art. Other objects and advantages of the apparatus of the present invention will become apparent from reading the description which follows in conjunction with the accompanying drawings.

DESCRIPTION OF A PREFERRED EMBODIMENT

Figure 1:
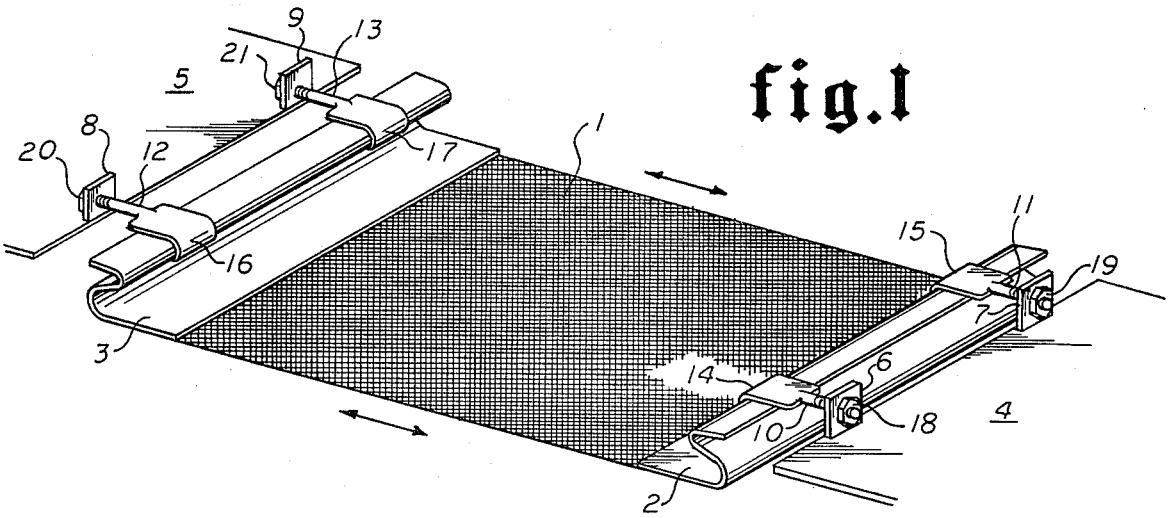
FIG. 1 is a perspective view of separating apparatus including a wire mesh screen, the edges of which are retained by retainer assemblies and the retainer assemblies of which are engaged by hook devices for applying oppositely directed forces to place the screen in tension.

Referring first to FIG. 1, there is shown a wire mesh screen 1, the edges of which are retained by retainer assemblies 2 and 3. On either side of the screen and retainer assemblies are mounting plates 4 and 5, upwardly from which extend mounting tabs 6, 7, 8 and 9 having holes therein for receiving threaded ends 10, 11, 12 and 13 of hook members 14, 15, 16 and 17 which engage respective retainer assemblies 2 and 3. Nuts 18, 19, 20 and 21 engage the respective threaded ends of the hook members so that oppositely directed forces may be applied to the retainer assemblies 2 and 3 for placing the screen 1 in tension as indicated by the arrows on the free edges thereof.

Figure 2:
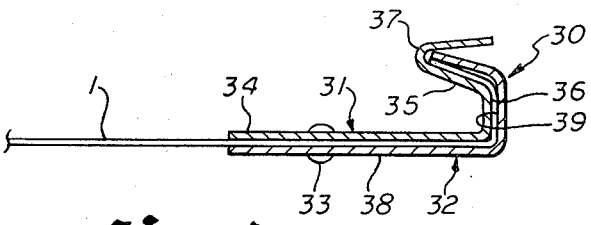
fig.2 (PRIOR ART)
FIG. 2 is a side view of one edge of a wire mesh screen retained by a retainer assembly according to an embodiment of the prior art.

Referring now to FIG. 2, one edge of wire mesh screen 1 is shown retained by a prior art retainer assembly 30. The retainer assembly 30 of the prior art includes a first rigid retainer member 31 and a second rigid retainer member 32. The first rigid retainer member includes an elongated flat base portion 34 from one edge of which upwardly projects a rib portion providing an elongated arcuate convex surface 36 and may have a double curvature for providing another elongated arcuate convex surface 37 facing in the opposite direction. The second arcuate convex surface 37 is the surface engaged by the tension hooks such as 14, 15, 16 and 17 in FIG. 1.

The second rigid retainer member also includes an elongated base portion 38 from one edge of which upwardly projects a curved rib portion providing an elongated arcuate concave surface 39. It will be noted that the edge of the wire mesh screen 1 is sandwiched between the first and second retainer members 31 and 32 and that the extreme edges of the wire mesh screen 1 are engaged by the convex and concave arcuate surfaces 36 and 39 of the first and second retainer members 31 and 32, respectively. Frequently, the first and second retainer members 31 and 32 and the edges of the wire mesh screen 31 are held together by spot welding of the base portions as at 33.

Figure 3:
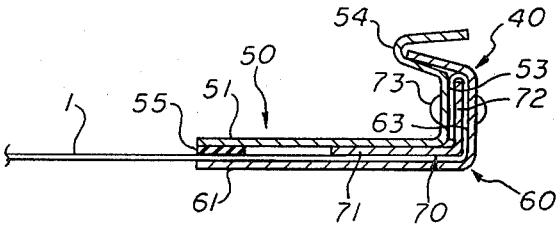
FIG. 3 is a side view of one edge of a wire mesh screen being retained by a retainer assembly according to a preferred embodiment of the invention.
Figure 4:
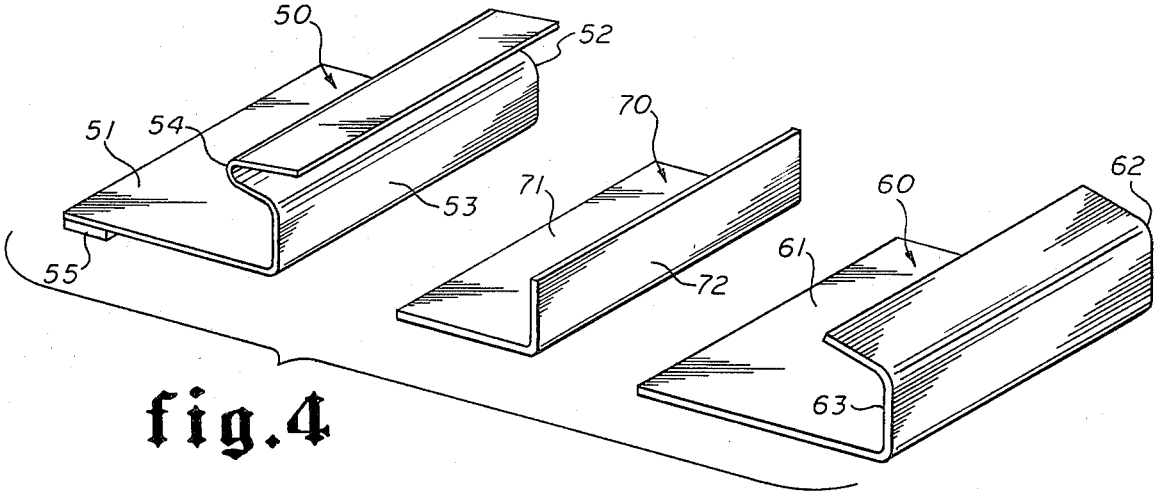
FIG. 4 is an isometric exploded view of a retainer assembly according to a preferred embodiment of the invention showing the various components thereof separated from each other for a better understanding thereof.

Referring now to FIGS. 3 and 4, a retainer assembly 40 according to a preferred embodiment of the invention is shown. In this retainer assembly 40 there are three components, first, second, third rigid retainer members 50, 60 and 70, respectively. The first rigid retainer member 50 includes an elongated flat base portion 51, having a free distal edge and a proximal edge from which upwardly projects a curved rib portion 52 providing an elongated arcuate convex surface 53 facing away from the distal edge of the base portion 51. The rib portion 52 has a double curvature providing, above the elongated arcuate convex surface 53, a second elongated arcuate convex surface 54 facing toward the distal edge of the base portion 51. In addition, an elongated strip of resilient frictional material 55 may be provided along the distal edge of the base portion 51.

The second retainer member 60 includes an elongated base portion 61 having a free distal edge and a proximal edge from which upwardly projects a curved rib portion 62 providing an elongated arcuate concave surface 63 facing toward the distal edge of the base portion 61. If desired, the elongated strip of resilient material 55 attached to the first retainer member 50 could be provided along the distal edge of the second retainer member 60. Although such a strip could be provided on either member, only one would be necessary.

The third rigid retainer member 70 includes a flat base portion 71 from one edge of which upwardly projects a rib portion 72. When assembled, as in FIG. 3, the base portion 71 is sandwiched between the flat base portions 51 and 61 of the first and second retainer members 50 and 60 and the rib portion 72 is disposed between the elongated arcuate convex surface 53 of the first retainer member 50 and the elongated arcuate concave surface 63 of the second retainer member 60. It will also be noted that the edge of the wire mesh screen 1 engages one side of the flat base portion 71 of the third retainer member 70 and is bent around the rib portion 72 to engage both sides thereof. Thus, the third retainer member 70 and the edge of screen 1 are sandwiched between the first and second retainer members 50 and 60. These conditions may be further maintained by spot welding through the rib portions of all three members 50, 60 and 70, as at 73.

When the force applying hooks, i.e. 14, 15, 16 and 17 in FIG. 1, are engaged with the convex surface 54 of first retainer member 50 and a force applied thereto, the third retainer member 70 and the edge of the screen 1 are tightly clamped and wedged between the arcuate surfaces 53 and 63 of the first and second retainer members 50 and 60. The tight clamping in conjunction with the spot welding and the frictional engagement of the corresponding surfaces of the base portions 51, 61, 71 and the frictional strip 55, all cooperate together to form an extremely secure retainer assembly from which the wire mesh screen 1 is least likely to escape.

Although a single embodiment of the invention has been described herein, many variations thereof can be made without departing from the spirit of the invention. For example, additional layers of wire mesh screen may be retained by the same retainer assemblies. Thus, when the term wire mesh screen is used in the claims, it is intended to cover as many layers of such screen as is desired. It is intended that the scope of the invention be limited only by the claims which follow.

I claim:

1. Apparatus for separating solid materials from mixtures having said solid materials therein including a wire mesh screen two opposing edges of which are retained by preformed elongated rigid retainer assemblies against which oppositely directed forces may be applied for placing said screen in tension, said rigid retainer assemblies comprising:

a first rigid retainer member preformed to include an elongated flat base portion having a free distal edge and a proximal edge from which upwardly projects a curved rib portion providing an elongated arcuate convex surface facing away from said distal edge of said base portion;

a second rigid retainer member preformed to include an elongated base portion having a free distal edge and a proximal edge from which upwardly projects a curved rib portion providing an elongated arcuate concave surface facing toward said distal edge of said base portion;

a third rigid retainer member preformed to include a flat elongated base portion for sandwiching between said flat base portions of said first and second retainer members and from one edge of which upwardly projects a rib portion for disposition between said elongated arcuate convex surface of said first retainer member and said elongated arcuate concave surface of said second retainer member;

said opposing edge of said wire mesh screen lying against one side of said flat base portion of said third retainer member and bent to lie against both sides of said third retainer member rib portion for engagement by both said elongated arcuate convex surface of said first retainer member and said elongated arcuate concave surface of said second retainer member.

2. Separating apparatus as set forth in claim 1 in which said third retainer member and said edge of said wire mesh screen are at least partially held in said sandwiched relationship between said first and second retainer members by spot welding through the rib portions of said first, second and third retainer members.

3. Separating apparatus as set forth in claim 1 in which the distal edge of at least one of said first and second retainer members is provided with an elongated strip of resilient frictional material for engagement with said wire mesh screen.

4. Separating apparatus as set forth in claim 3 in which said flat base portion of said third retainer member is of less width than corresponding flat base portions of said first and second retainer members leaving an elongated space between the distal edges of said flat base portions of said first and second retainer members, said elongated strip of resilient frictional material being disposed in said elongated space.

5. Separating apparatus as set forth in claim 1 in which said opposing edge of said wire mesh screen is disposed between said second retainer member flat base portion and the side of said third retainer member flat base portion adjacent thereto.

6. Separating apparatus as set forth in claim 1 in which said first retainer rib portion has a double curvature providing above said elongated arcuate convex surface a second elongated arcuate convex surface facing toward said distal end of said base portion for engagement by means for applying said oppositely directed forces.

* * * * *